United States Patent [19]

Mieda

[11] 4,276,802

[45] Jul. 7, 1981

[54] ELECTRONIC KEYBOARD INSTRUMENT

[75] Inventor: Fumio Mieda, Sakado, Japan

[73] Assignee: Keio Giken Kogyo Kabushiki Kaisha, Tokyo, Japan

[21] Appl. No.: 26,515

[22] Filed: Apr. 3, 1979

[30] Foreign Application Priority Data

Apr. 3, 1978 [JP] Japan ..... 53/38943

[51] Int. Cl.[3] ..... G10H 1/12; G10H 5/00

[52] U.S. Cl. ..... 84/1.19; 84/1.21; 84/1.24; 84/DIG. 9

[58] Field of Search ..... 84/1.01, 1.11, 1.12, 84/1.19, 1.21, 1.24, 1.28, 462, DIG. 9, 1.09, 1.1, 1.27

[56] References Cited

U.S. PATENT DOCUMENTS

| | | | |
|---|---|---|---|
| 3,277,245 | 10/1966 | Sponga | 84/462 X |
| 3,479,440 | 11/1969 | Martin et al. | 1.24 X/ |
| 3,520,984 | 7/1970 | Machanian | 94/1.24 |
| 3,539,701 | 11/1970 | Milde | 84/1.28 |
| 3,598,891 | 8/1971 | Adachi | 84/1.24 |
| 3,867,862 | 2/1975 | Jones et al. | 84/1.19 |
| 3,911,776 | 10/1975 | Beigel | 84/DIG. 9 |
| 4,077,298 | 3/1978 | Kondo | 84/1.01 X |
| 4,142,434 | 3/1979 | Gross | 84/1.01 |

*Primary Examiner*—Stanley J. Witkowski

*Attorney, Agent, or Firm*—Pollock, Vande Sande and Priddy

[57] ABSTRACT

An electronic keyboard instrument generates signals of frequencies respectively corresponding to keys by depressing the keys of a keyboard from a signal source, and reproduces a musical note corresponding to the generated signal. The frequency spectrum of an external signal is detected and used to control the frequency spectrum of the generated signal to cause the frequency spectrum of the generated signal to approximate that of the external signal.

10 Claims, 4 Drawing Figures

ELECTRONIC KEYBOARD INSTRUMENT

BACKGROUND OF THE INVENTION

This invention relates to an electronic keyboard instrument, and more particularly to an electronic keyboard instrument which is adapted to make its tone approximate to a tone of an external signal.

Generally, an electronic keyboard instrument produces a musical note corresponding to electric signals from a speaker and has the property of obtaining various tones by freely shaping the waveform of the electrical signal. To this end, the electronic keyboard instrument is usually designed to produce sounds of tones approximate to those of musical instruments, such as a violin, a flute, an organ, a piano, a clarinet, a glockenspiel, etc. by changeover of a switch.

In the prior art, signals of respective scales selected by keyboard switches are applied to fixed filters for waveform shaping to obtain various tones. Accordingly, the fixed filters are each provided for each tone and selected by the player's switch changeover operation to play a tune in a desired tone.

SUMMARY OF THE INVENTION

This invention provides an electronic keyboard instrument in which an external input terminal is provided separately of such a tone changeover switch and a desired signal, for example, an audio signal of a player's voice, is applied to the external input terminal, thereby to produce a sound approximate to the tone of the signal.

DESCRIPTION OF THE PREFERRED EMBODIMENTS

Figure 1:
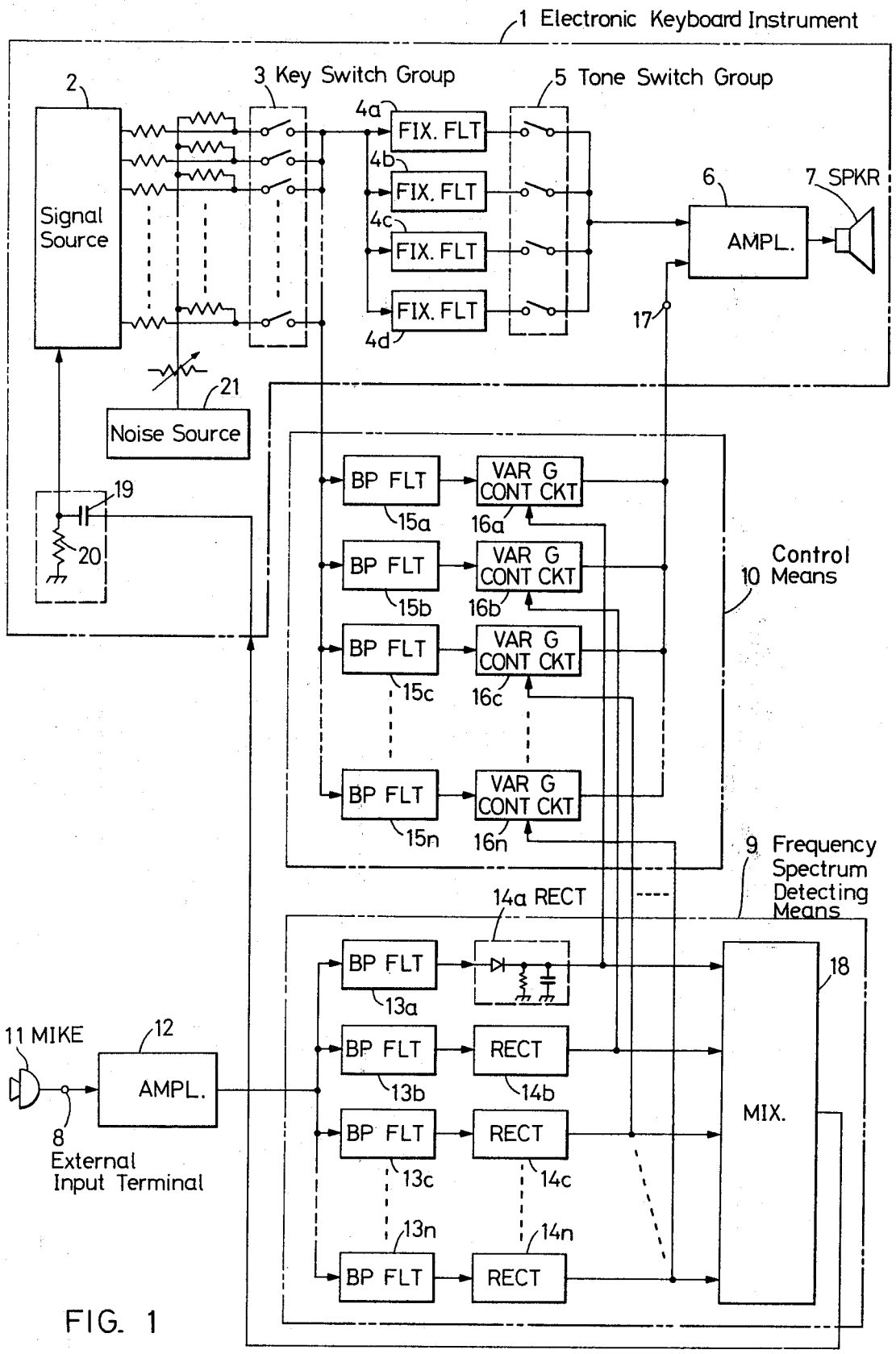
FIG. 1 is a block diagram illustrating an embodiment of this invention.

In FIG. 1, reference numeral 1 indicates a conventional electronic keyboard instrument, which comprises a signal source 2 formed, for example, with a voltage controlled oscillator group, for producing signals of frequencies of respective scales, a key switch group 3 for selectively picking up the signals of the respectively scales derived from the signal source 2, a plurality of fixed filters 4*a*, 4*b*, 4*c* and 4*d* for converting the signals from the key switch group 3 into various kinds of waveforms to provide tones of various musical instruments, a tone switch group 5 for selectively applying the outputs from the fixed filters 4*a* to 4*d* to an amplifier 6 and a speaker 7 for converting the amplified signal to a sound.

With the present invention, there are provided in such an electronic keyboard instrument 1 an external input terminal 8, spectrum detecting means 9 for detecting the frequency spectrum of a signal applied to the external input terminal 8 and means 10 for approximating the frequency spectrum of the signal of the electronic keyboard instrument 1 to the frequency spectrum of the external signal with the detected output from the spectrum detecting means 9.

In the illustrated embodiment, a microphone 11 is connected to the external terminal 8 and an audio signal picked up by the microphone 11 is amplified by amplifier 12, if necessary, and the amplified output is applied to the frequency spectrum detecting means 9. The frequency spectrum detecting means 9 can be formed for instance, with a plurality of band pass filters 13*a*, 13*b*, 13*c*, . . . 13*n* of different center frequencies, by which respective frequency components of the external signal picked up by the microphone 11 are analyzed to detect its frequency spectrum. The outputs from the band-pass filters 13*a* through 13*n* are respectively rectified by rectifiers 14*a* through 14*n* and the rectified outputs are applied to the means 10.

The means 10 can be composed, for example, of a plurality of band-pass filters 15*a* through 15*n* of different center frequencies for analyzing frequency components of the scale signals selected by the key switch group 3, as is the case with the spectrum detecting means 9, and a plurality of variable gain control circuits 16*a* through 16*n* for changing the levels of the analyzed output signals from the band-pass filters 15*a* through 15*n*.

To the variable gain control circuits 16*a* through 16*n* are respectively connected the rectified outputs from the means 9 to control the gains of the variable gain control circuits 16*a* through 16*n* in proportion to the respective analyzed frequency components of the external signal. As a consequence, the variable gain control circuits 16*a* through 16*b* provide respective frequency components of levels which are substantially approximate to the analyzed frequency components of the external signal. These outputs are added together to obtain at a terminal 17 a signal having a frequency spectrum substantially approximate to that of the external signal, which signal is applied via the amplifier 6 to the speaker 7.

As a result of this, the sound produced from the speaker 7 has an interval selected on the keyboard 1 and a tone nearly approximate to that of the external signal picked up by the microphone 11. Accordingly, for example, if a player depresses a key while uttering through the microphone 11, a sound which has the same interval as the depressed key and is similar to the player's voice is created from the speaker 7 of the keyboard instrument 1. Therefore, if the player simultaneously depresses a plurality of keys while singing, a sound just like a chorus is produced.

It is also possible to mix the rectified outputs from the rectifiers 14*a* through 14*n* by a mixer 18, apply the mixed output via a capacitor 19 to a resistor 20 and supply the resulting voltage signal at the resistor 20 to a voltage control terminal of the signal source 2, whereby to modulate, for example, the frequency of the scale signal derived from the signal source 2. With such an arrangement, when the level of an external signal suddenly changes, its differentiated output is provided at the resistor 20 and, by the differentiated signal, the frequency of the scale signal is modulated, so that the sound created from the speaker 7 can be made more approximate to the external signal.

Figure 2:
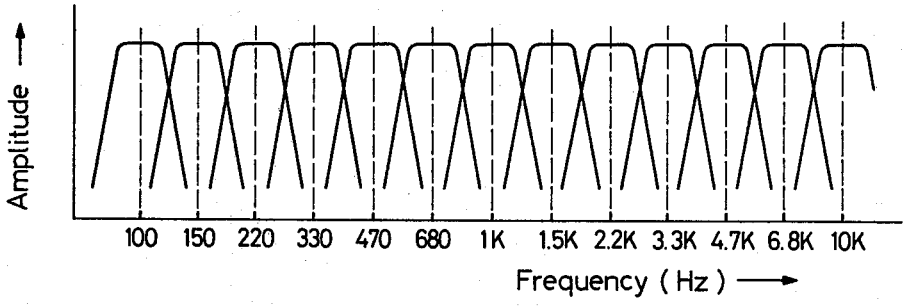
FIG. 2 is a graph explanatory of the operation of the principal part of this invention.

The pass-band frequencies of the band-pass filters 13*a* and 15*a*, 13*b* and 15*b*, 13*c* and 15*c*, . . . 13*n* and 15*n* are respectively selected equal to each other. The center frequencies of the band-pass filters 13*a* and 15*a*, 13*b* and 15*b*, 13*c* and 15*c*, . . . are preferred to be selected, for example, 100 Hz, 150 Hz, 220 Hz . . . , as shown in FIG. 2. FIG. 2 shows the case where the external signal and the signal from the electronic keyboard instrument are frequency analyzed by thirteen band-pass filters. It is preferred to make the numbers of band-pass filters 13*a* through 13*n* and 15*a* through 15*n* as large as possible but, in practice, ten to twenty band-pass filters will suffice to make a sound of the electronic keyboard instrument 1 approximate to the sound of an external signal.

In the embodiment of FIG. 1, a noise source 21 is provided for superimposing, for example, a white noise, on each signal of the signal source 2. By superimposing the white noise on the scale signal, the sound from the speaker 7 is heard as if it is a natural sound. But this is not essentially related to the present invention.

As described above, according to this invention, a sound of the electronic keyboard instrument can be made approximate to the tone of a sound picked up by the microphone 11; for example, by applying the player's voice or a sound of another musical instrument to the microphone 11, a scale signal of a tone close to the applied external signal can be obtained.

Figure 3:
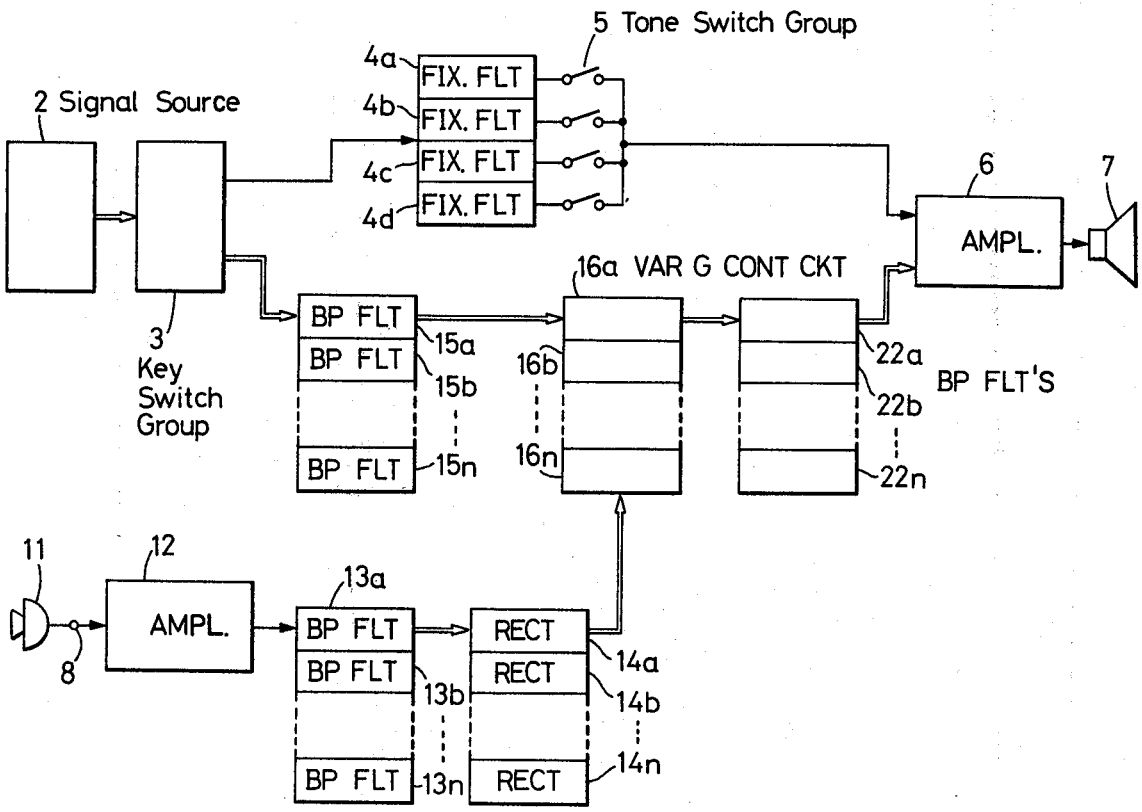
FIGS. 3 and 4 are block diagrams showing other embodiments of this invention.

FIG. 3 illustrates another example of the principal part of this invention, in which the variable gain control circuits 16*a* through 16*n* have a nonlinear characteristic to avoid distortion of a signal. To this end, at the output sides of the variable gain control circuits 16*a* through 16*n*, there are provided band-pass filters 22*a* through 22*n*, each having the same characteristic as the corresponding ones of the band-pass filters 13*a* through 13*n* and 15*a* through 15*n* provided before the variable gain control circuits 16*a* through 16*n*. With such an arrangement, distortion occurring in the variable gain control circuits 16*a* through 16*n* can be removed by the band-pass filters 22*a* through 22*n*. Where the band-pass filters 22*a* through 22*n* are respectively connected to the output sides of the variable gain control circuits 16*a* through 16*n*, the band-pass filters 15*a* through 15*n* need not always be provided.

Figure 4:
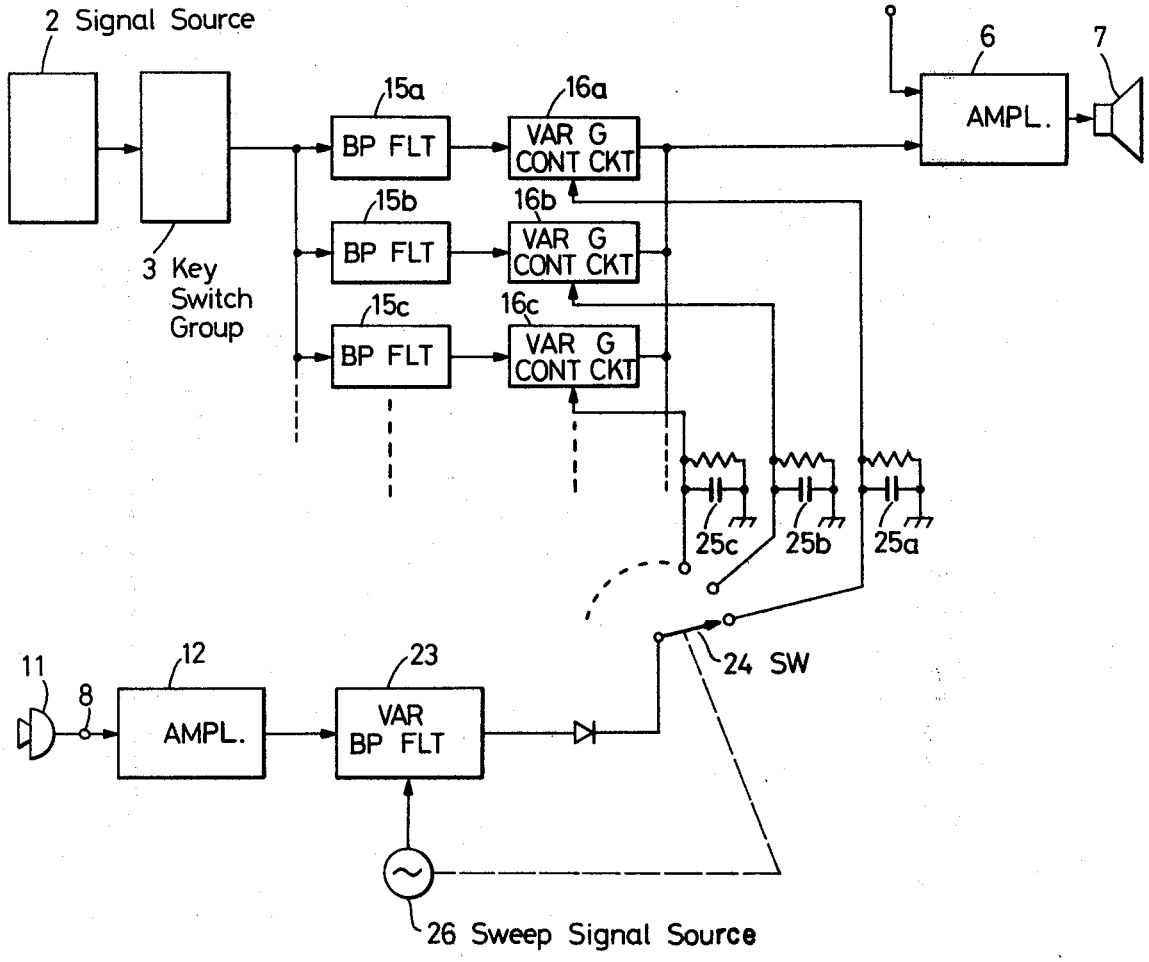

FIG. 4 shows still another example of this invention, in which the external signal supplied from the external input terminal 8 is applied to a variable band-pass filter 23 to sweep its center frequency, whereby to frequency analyze the external input signal on a time divided basis. To perform this, as the center frequency of the variable band-pass filter 23 is swept, a switch 24 is changed over step by step and, in synchronism with the stepping of the switch 24, the results of the frequency analysis at respective frequency positions are temporarily stored in capacitors 25*a*, 25*b*, 25*c*, . . . and by the stored values, the gains of the variable gain control circuits 16*a* through 16*n* are controlled. The center frequency of the variable band-pass filter 23 is repeatedly swept by a sawtooth wave or a sine wave from a sweep signal source 26 and the switch 24 is changed over in synchronism with this sweep. Accordingly, it is sufficient that the capacitors 25*a*, 25*b*, 25*c*, . . . store for only one sweep period.

Where the storage time of the capacitors 25*a*, 25*b*, 25*c*, . . . can be selected sufficiently long, if the switch 24 is stopped in its step movement, as required, so that it is not connected to any contacts, immediately preceding frequency analysis results can be stored in the capacitors 25*a*, 25*b*, 25*c*, . . . . The system of storing the frequency analysis results in capacitors, as described above, is applicable not only to the frequency sweep system shown in FIG. 4 but also to the frequency analysis system described previously with respect to FIG. 1.

As has been described in the foregoing, according to the present invention, a variety of sounds unobtainable with conventional electronic keyboard instruments can easily be produced without the necessity of increasing the number of fixed filters; therefore, this invention enhances the performance effect of the electronic keyboard instrument and has great utility in practice.

It will be apparent that many modifications and variations may be effected without departing from the scope of novel concepts of this invention.

What is claimed is:

1. An electronic keyboard instrument wherein note signals each containing a pitch frequency and harmonics respectively corresponding to keys of a keyboard are selectively generated from an internal signal source by depressing the keys and musical tones corresponding to the generated note signals from the internal signal source are reproduced, the electronic keyboard instrument comprising: an external input terminal for supplying thereto an external sound signal; frequency spectrum detecting means coupled to said input terminal and having band-pass characteristics at predetermined center frequencies for detecting the spectrum components and their levels of the external sound signal which approximately represent the tone color of the external sound signal; bandpass filter means, having center frequencies respectively corresponding to the center frequencies of the spectrum detecting means, for separately extracting the spectrum components of note signals generated from the internal signal source; and level control means for controlling, with the respective levels of the spectrum components detected by said frequency spectrum detecting means, the levels of the respectively corresponding spectrum components of the note signals extracted by the bandpass filter means at the respective center frequencies, thereby to reproduce musical tones each of which has a tone color similar to that of the external sound signal.

2. An electronic keyboard instrument according to claim 1, wherein the frequency spectrum detecting means is composed of a plurality of first band-pass filters of different center frequencies, and a plurality of rectifiers for rectifying the outputs from the respective bandpass filters.

3. An electronic keyboard instrument according to claim 1, which further comprises a circuit for differentiating the external signal, and means for frequency modulating the selectively generated signal of the frequency corresponding to the depressed key with the output from the differentiating circuit.

4. An electronic keyboard instrument according to claim 1, wherein the frequency spectrum detecting means is composed of a variable filter supplied with the external signal and having the center frequency of its pass band periodically changed by an electric signal, and storage elements for respectively storing frequency components separated by the variable filter.

5. An electronic keyboard instrument according to claim 1, which further includes a noise source for superimposing noise on the selectively generated signal of the electronic keyboard instrument.

6. An electronic keyboard instrument in which signals of frequencies respectively corresponding to keys are each selectively generated from a signal source by depressing the keys of a keyboard and musical notes corresponding to the generated signals are reproduced from the signal source, the electronic keyboard instrument comprising an external input terminal to which an external signal may be supplied;

means coupled to said input terminal for detecting the frequency spectrum of an external signal supplied to said input terminal, said frequency spectrum detecting means being composed of a plurality of first band-pass filters of different center frequencies and a plurality of rectifiers for rectifying the outputs from the respective band-pass filters; and control means for making the frequency spectrum of the selectively generated signal of the electronic keyboard instrument approximately the same as the frequency spectrum of the external signal, said control means being composed of a plurality of second band-pass filters each supplied with the selectively generated signal corresponding to the key being depressed and having the same frequency band as the corresponding one of the first band-pass filters, and a plurality of level control circuits for controlling the levels of the outputs from the second band-pass filters in accordance with the outputs from the corresponding rectifiers.

7. An electronic keyboard instrument according to claim 6, wherein there are provided at the output sides of the level control circuits a plurality of third bandpass filters, each permitting the passage therethrough of only frequency components supplied to a corresponding one of the level control circuit.

8. An electronic keyboard instrument in which signals of frequencies respectively corresponding to keys are each selectively generated from a signal source by depressing the keys of a keyboard and musical notes corresponding to the generated signals are reproduced from the signal source, the electronic keyboard instrument comprising an external input terminal to which an external signal may be supplied; means coupled to said input terminal for detecting the frequency spectrum of an external signal supplied to said input terminal, said frequency spectrum detecting means being composed of a variable band-pass filter which has the center frequency of its pass band periodically changed by an electric signal, and storage elements for respectively storing frequency components separated by said variable bandpass filter; and control means for making the frequency spectrum of the selectively generated signal of the electronic keyboard instrument approximately the same as the frequency spectrum of the external signal, said control means including a plurality of further bandpass filters respectively permitting the passage therethrough of frequencies corresponding to the signals stored in said storage elements and supplied with the selectively generated signal of the frequency corresponding to the depressed key, and a plurality of level control circuits for respectively controlling the levels of the outputs from said further bandpass filters in accordance with the outputs from the corresponding storage elements.

9. An electronic keyboard instrument in which signals of frequencies respectively corresponding to keys are each selectively generated from a signal source by depressing the keys of a keyboard and musical notes corresponding to the generated signals are reproduced from the signal source, the electronic keyboard instrument comprising an external input terminal to which an external signal may be supplied; means coupled to said input terminal for detecting the frequency spectrum of an external signal supplied to said input terminal, said frequency spectrum detecting means being composed of a plurality of first bandpass filters of different center frequencies and a plurality of rectifiers for rectifying the outputs from the respective bandpass filters; and control means for making the frequency spectrum of the selectively generated signal approximately the same as the frequency spectrum of said external signal, said control means being composed of a plurality of level control circuits respectively corresponding to said bandpass filters, said level control circuits being supplied with the selectively generated signal of the frequency corresponding to the depressed key and being operative to control the level of the signal in accordance with the outputs from the corresponding rectifiers, and a plurality of further bandpass filters respectively connected to the output sides of said level control circuits and having the same frequency characteristics as the corresponding first bandpass filters.

10. An electronic keyboard instrument in which signals of frequencies respectively corresponding to keys are each selectively generated from a signal source by depressing the keys of a keyboard and musical notes corresponding to the generated signals are reproduced from the signal source, the electronic keyboard instrument comprising an external input terminal to which an external signal may be supplied; means coupled to said input terminal for detecting the frequency spectrum of an external signal supplied to said input terminal, said frequency spectrum detecting means being composed of a plurality of bandpass filters of different center frequencies and a plurality of rectifiers for rectifying the outputs from the respective bandpass filters; and control means for making the frequency spectrum of the selectively generated signal approximately the same as the frequency spectrum of said external signal, said control means including a mixer for mixing the rectified outputs from the rectifiers, a differentiating circuit for differentiating the output of the mixer, and means for frequency modulating the selectively generated signal of the frequency corresponding to the depressed key with the output from said differentiating circuit.

* * * * *